US006335518B1

(12) United States Patent
Kim

(10) Patent No.: US 6,335,518 B1
(45) Date of Patent: Jan. 1, 2002

(54) MICROWAVE OVEN WITH TEMPERATURE SENSOR ASSEMBLY

(75) Inventor: Dae-rae Kim, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/754,298

(22) Filed: Jan. 5, 2001

(30) Foreign Application Priority Data

Oct. 26, 2000 (KR) ..... 00-63222

(51) Int. Cl.[7] ..... H05B 6/68

(52) U.S. Cl. ..... 219/710; 219/757; 374/149; 126/21 A

(58) Field of Search ..... 219/757, 710, 219/711, 712; 374/149; 126/21 A

(56) References Cited

U.S. PATENT DOCUMENTS 4,162,381 A * 7/1979 Buck ..... 219/757
4,998,001 A * 3/1991 Cigarini et al. ..... 219/710
5,140,120 A * 8/1992 Kasai et al. ..... 219/757
5,575,943 A * 11/1996 Lee ..... 219/710
5,780,822 A * 7/1998 Lee ..... 219/710

FOREIGN PATENT DOCUMENTS

JP 1-19232 * 1/1989 ..... 219/710

* cited by examiner

*Primary Examiner*—Philip H. Leung
(74) *Attorney, Agent, or Firm*—Robert E. Bushnell, Esq.

(57) ABSTRACT

Disclosed is a microwave oven having a cavity casing forming a cooking compartment, comprising a temperature sensor sensing a temperature of the cooking compartment; a duct member installed on the top face of the cavity casing, guiding a flow of air, having an opening toward the cavity casing at one side thereof, and a holder sensor provided on an inner wall of the duct member, holding the temperature sensor. With this configuration, an operational process for installing the temperature sensor in the microwave oven is simplified and the cost of production can be reduced.

11 Claims, 5 Drawing Sheets

MICROWAVE OVEN WITH TEMPERATURE SENSOR ASSEMBLY

CLAIM OF PRIORITY

This application makes reference to, incorporates the same herein, and claims all benefits accruing under 35 U.S.C. §119 from my application entitled MICROWAVE OVEN filed with the Korean Industrial Property Office on Oct. 26, 2000 and there duly assigned Serial No. 2000-63222.

BACKGROUND OF THE INVENTION

1. Technical Field

The present invention relates in general to microwave ovens, and more particularly, to a microwave oven having a sensor holder in a duct member, holding a temperature sensor.

2. Description of Related Art

The present invention will be described by applying it to a wall-mounted type of microwave oven. Generally, the wall-mounted microwave oven is installed over cookers such as a gas range, is etc., which functions as a hood to draw in smoke and smell generated in the gas range and discharge them.

FIG. 5 is an exploded perspective view of a conventional wall-mounted microwave oven. As shown therein, the conventional wall-mounted microwave oven is comprised of a main casing 101 having a cooking compartment 110 and a component chamber 115, an outer casing 105 taking a shape of an inverse "U," surrounding the main casing 101 and defining an outer appearance of the microwave oven, and a lower casing 103 coupled to the lower part of the main casing 101.

On top of the outer casing 105 is formed an exhaust port 107, and on the planar surface of the lower casing 103 are formed a pair of suction ports 106.

The main casing 101 is comprised of a front plate 117 and a rear plate 118 which are coupled to the outer casing 105, and a cavity casing 165 interposed between the front plate 117 and the rear plate 118, taking a shape of a rectangular box and forming a cooking compartment 110 inside thereof. On top of the cavity casing 165 is provided a duct member 125 guiding flow of an air.

On the top face of the cavity casing 165 is provided a sensor bracket 127 for installing a temperature sensor 150 therein, sensing a temperature of the cooking compartment 110. The temperature sensor 150 is comprised of a flange 151 provided at one end of the temperature sensor 150 for coupling with the sensor bracket 127, and a pair of terminals provided in the other end of the temperature sensor 150, supplying an external power to the temperature sensor 150.

The sensor bracket 127 takes a shape of "⊂," the closed side of which is fixed to the cavity casing 165 by welding, and the open side of which is separated from the top face of the cavity casing 165 with a predetermined space so that the flange 151 of the temperature sensor 150 is inserted thereinto.

Duct member 125 has recess 126 accommodating therein temperature sensor 105 inserted into sensor bracket 127. An electrical lead (not shown) for power supply is connected to terminals 152 of temperature sensor 150 and is drawn out through recess 126.

In the conventional microwave oven, to install the temperature sensor 150 on the top face of the cavity casing 165, one side of the sensor bracket 127 has to be welded, and thereafter, the temperature sensor 150 has to be inserted into the other side of the sensor bracket 127 spaced therefrom, thereby making it cumbersome to prepare the installment of the temperature sensor 150 therein. Additionally, the conventional microwave oven lowers the efficiency of operational processes and increases the cost of production, due to the welding operation of the sensor bracket 127.

SUMMARY OF THE INVENTION

Accordingly, the present invention has been made in view of the above-described shortcomings, and it is an object of the present invention to provide a microwave oven having a sensor holder in a duct member, holding a temperature sensor.

This and other objects of the present invention may be achieved by a provision of a microwave oven having a cavity casing forming a cooking compartment, comprising a temperature sensor sensing a temperature of the cooking compartment; a duct member installed on the top face of the cavity casing, guiding a flow of air, having an opening toward the cavity casing at one side thereof; and a holder sensor provided on an inner wall of the duct member, holding the temperature sensor.

The sensor holder includes a pair of arms surrounding the outside of the temperature sensor, and a detent disposed between the pair of arms preventing the temperature sensor from being removed therefrom.

The temperature sensor has a flange radially extended from one end thereof, and the pressing means includes a spring disposed between the detent and the flange.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
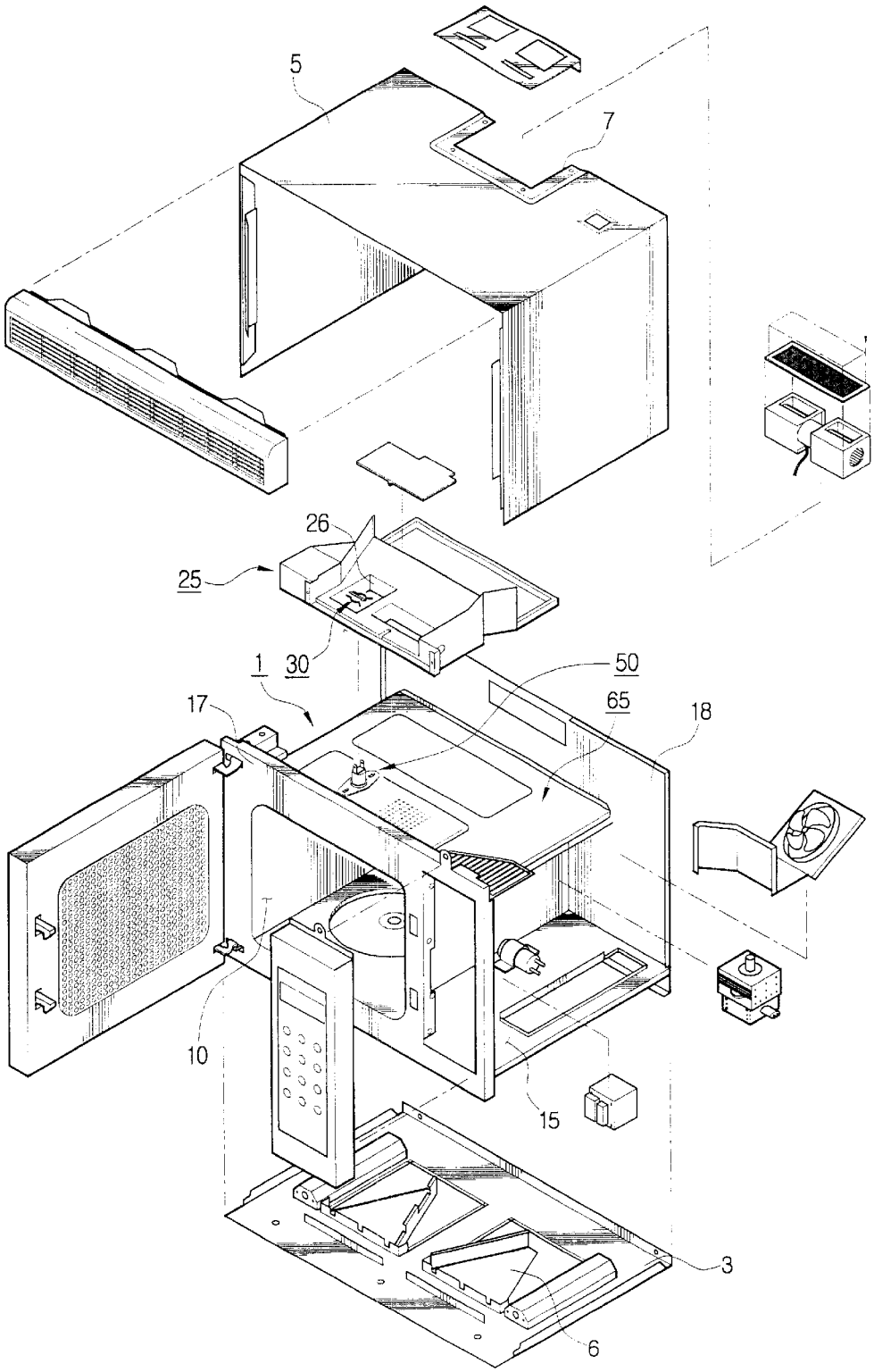
FIG. 1 is an exploded perspective view of a wall-mounted microwave oven according to the present invention.

Referring to FIG. 1 which is an exploded perspective view of a wall-mounted microwave oven according to the present invention, the wall-mounted microwave oven is comprised of a main casing 1 forming a main body, an outer casing 5 surrounding the main casing 1, defining an outer appearance of the microwave oven, and a lower casing 3 coupled to the lower part of the main casing 1.

The outer casing 5 takes a form of inverse "U," having an exhaust port 7 at the top face of the outer casing 5. The lower casing 3 is of rectangular plate type, having a pair of suction ports 6.

The main casing 1 is comprised of a front plate 17 and a rear plate 18 coupled to the front and the rear of the outer casing 5, and a cavity casing 65 disposed between the front plate 17 and the rear plate 18, functioning as a partition to partition a cooking compartment 10 and a component chamber 15. On the top of the cavity casing 65 is installed a duct member 25 guiding a flow of air.

The wall-mounted microwave oven according to the present invention will be described in more detail with respect to FIGS. 1, 2 and 3.

Figure 2:
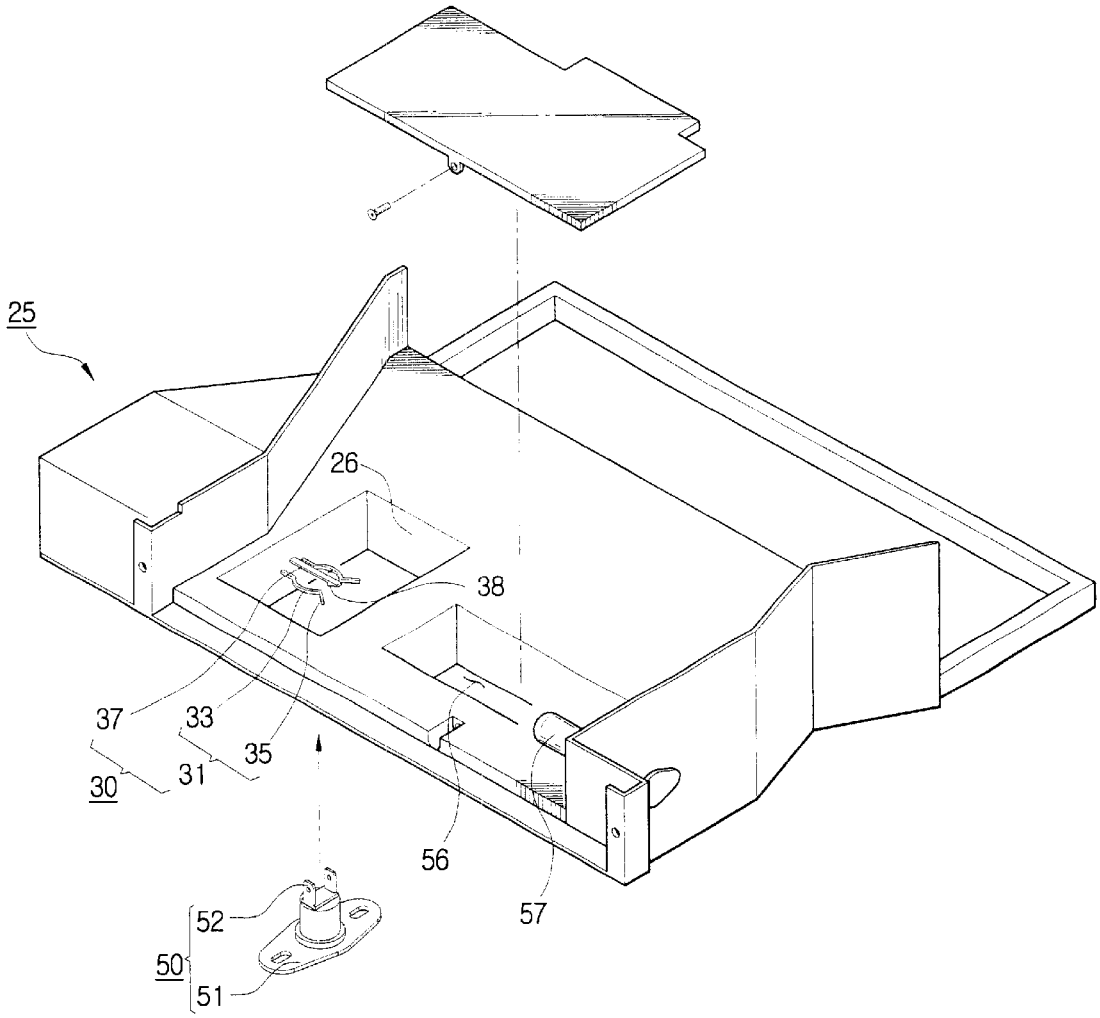
FIG. 2 is an enlarged perspective view of a duct member and a temperature sensor of FIG. 1.

As shown in FIG. 2, duct member 25 is formed with recess 26 having an upper and a lower openings through which temperature sensor 50 is installed, and lamp accommodating part 56 in which lamp 57 is installed, to illuminate the inside of cooking compartment 10.

A flange 51 extends radially from one end of temperature sensor 50. A terminal 52 supplying electric power to the temperature sensor 50 is located at the other end of temperature sensor 50. An electrical lead (not shown) for the power supply is connected to terminal 52 of temperature sensor 50, and the electrical lead is drawn through recess 26.

A sensor holder 30 is positioned on the inner wall of the recess 26 to allow the temperature sensor 50 to be fixed on the top face of the cavity casing 65.

Figure 3:
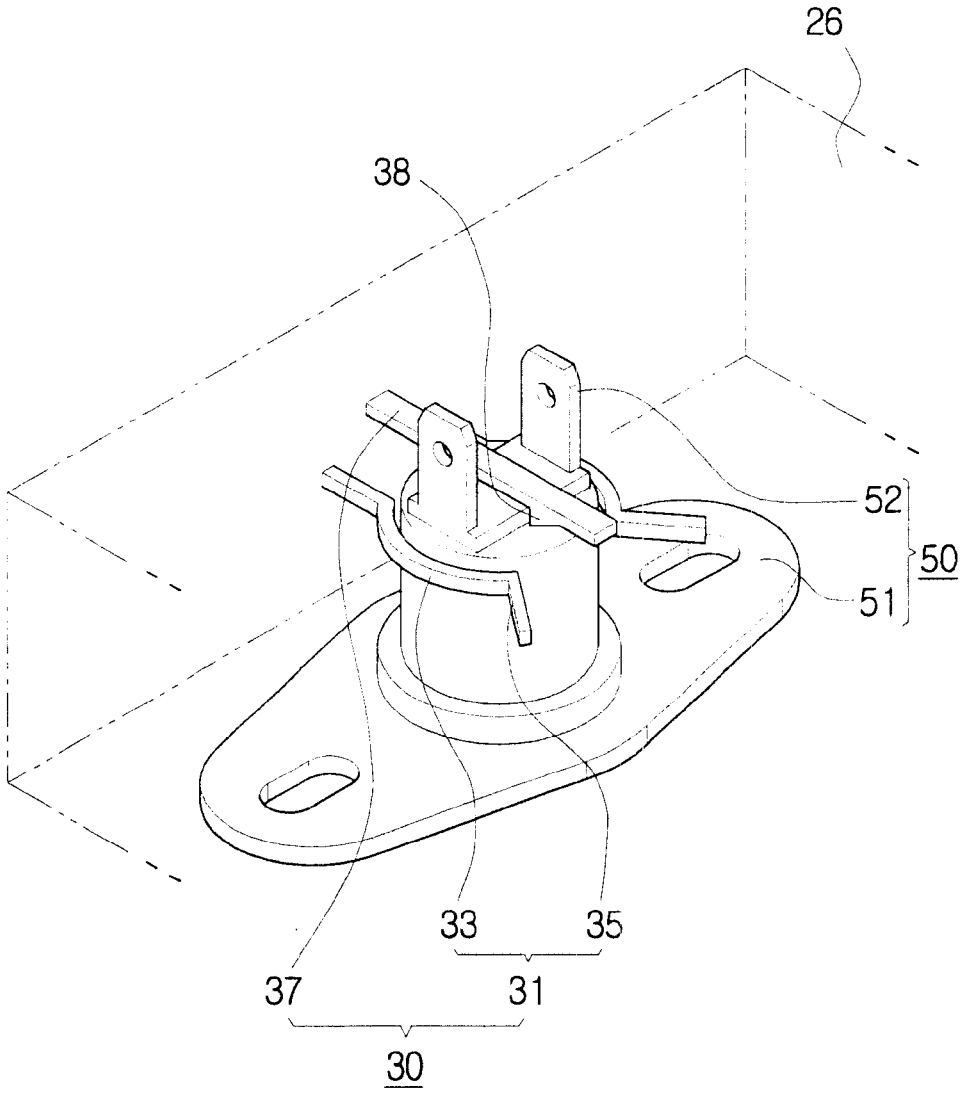
FIG. 3 is a view showing an assembly of the temperature sensor and the sensor holder of FIG. 2.

Sensor holder 30, as shown in FIG. 3, includes a pair of arms 31 taking a shape of arc, being opposed to each other, and detent 37 disposed between the pair of arms 31 to prevent temperature sensor 50 from being removed therefrom. Each of the arms 31 includes intermediate section 33 surrounding an outer surface of temperature sensor 50, and end section 35 inclined oppositely to temperature sensor 50, so that temperature sensor 50 is smoothly inserted between free ends of arms 31. Detent 37 takes a shape of rod which is elastically deformable, by pressing the upper of the temperature sensor 50 so that temperature sensor 50 cannot be removed therefrom. Detent 37 has protrusion 38 for preventing temperature sensor 50 from moving vertically.

With this configuration, temperature sensor 50 is installed in sensor holder 30 formed on the inner wall of recess 26. Temperature sensor 50 is guided into intermediate section 33 through end section 35 of arms 31 to hold therein when temperature sensor 50 is moved horizontally relative to arms 31. If temperature sensor 50 is held by arms 31 and protrusion 38 of detent 37 is engaged with the top of temperature sensor 50, temperature sensor 50 is pressed downwardly so as to be closely contacted with the top face of cavity casing 65.

With sensor holder 30 to allow temperature sensor 50 to be fixed in the inner wall of recess 26 located in duct member 25, temperature sensor 50 can be closely contacted with the top face of cavity casing 65, without performing a welding process to fix the sensor holder to the top face of cavity casing 65, thereby decreasing the number of operations and further the cost of production.

Temperature sensor 50 can be installed on the top face of cavity casing 65 by coupling temperature sensor 50 to the sensor holder, and then fixing duct member 25 to the top face of cavity casing 65. Alternatively, the temperature sensor 50 can be installed on the top face of cavity casing 65 by first fixing duct member 25 to the top face of cavity casing 65, and then coupling temperature sensor 50 to the sensor holder through recess 26.

Figure 4:
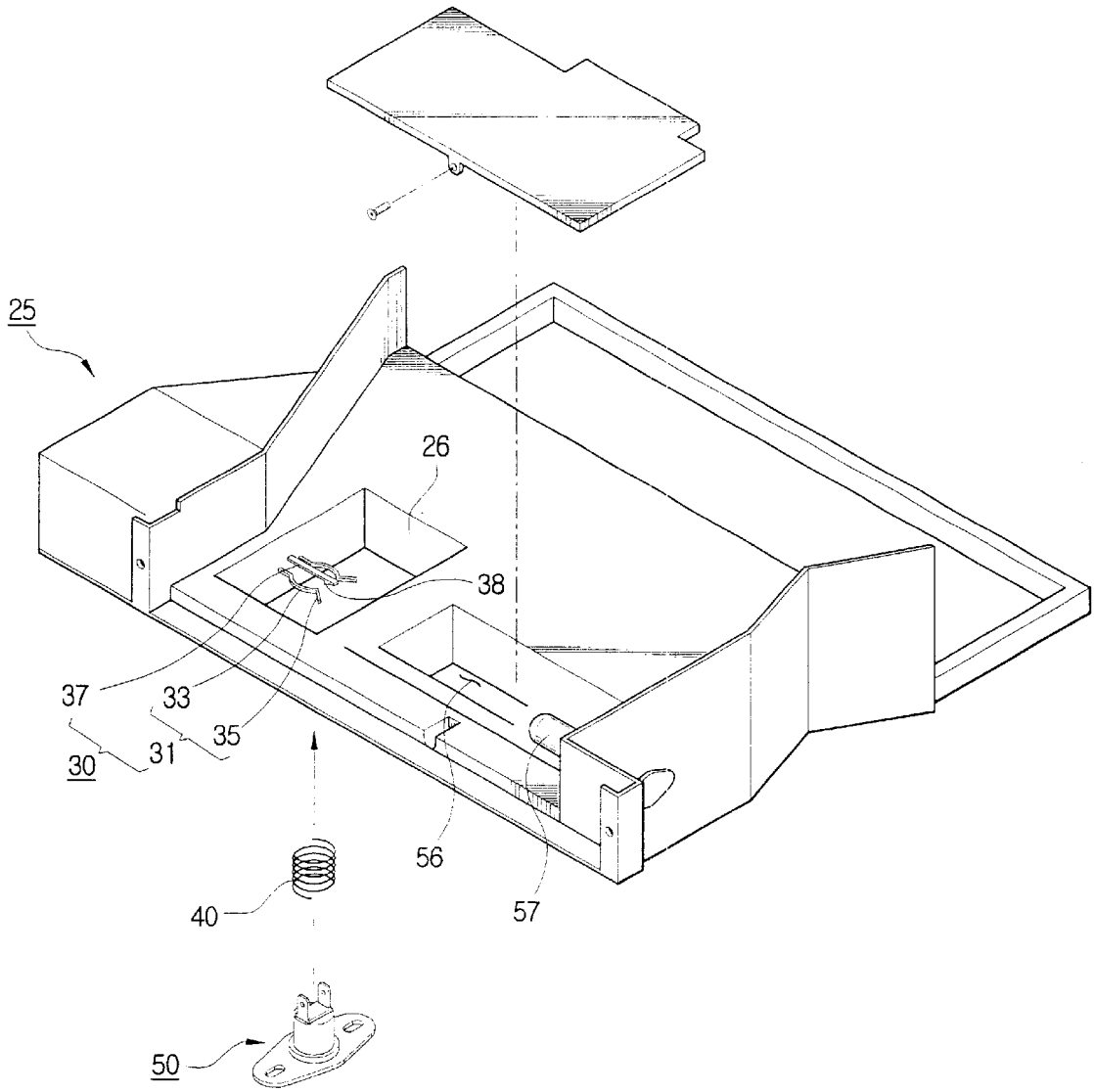
FIG. 4 is an exploded view of the temperature sensor and the sensor holder of FIG. 2 according to another embodiment of the present invention.
Figure 5:
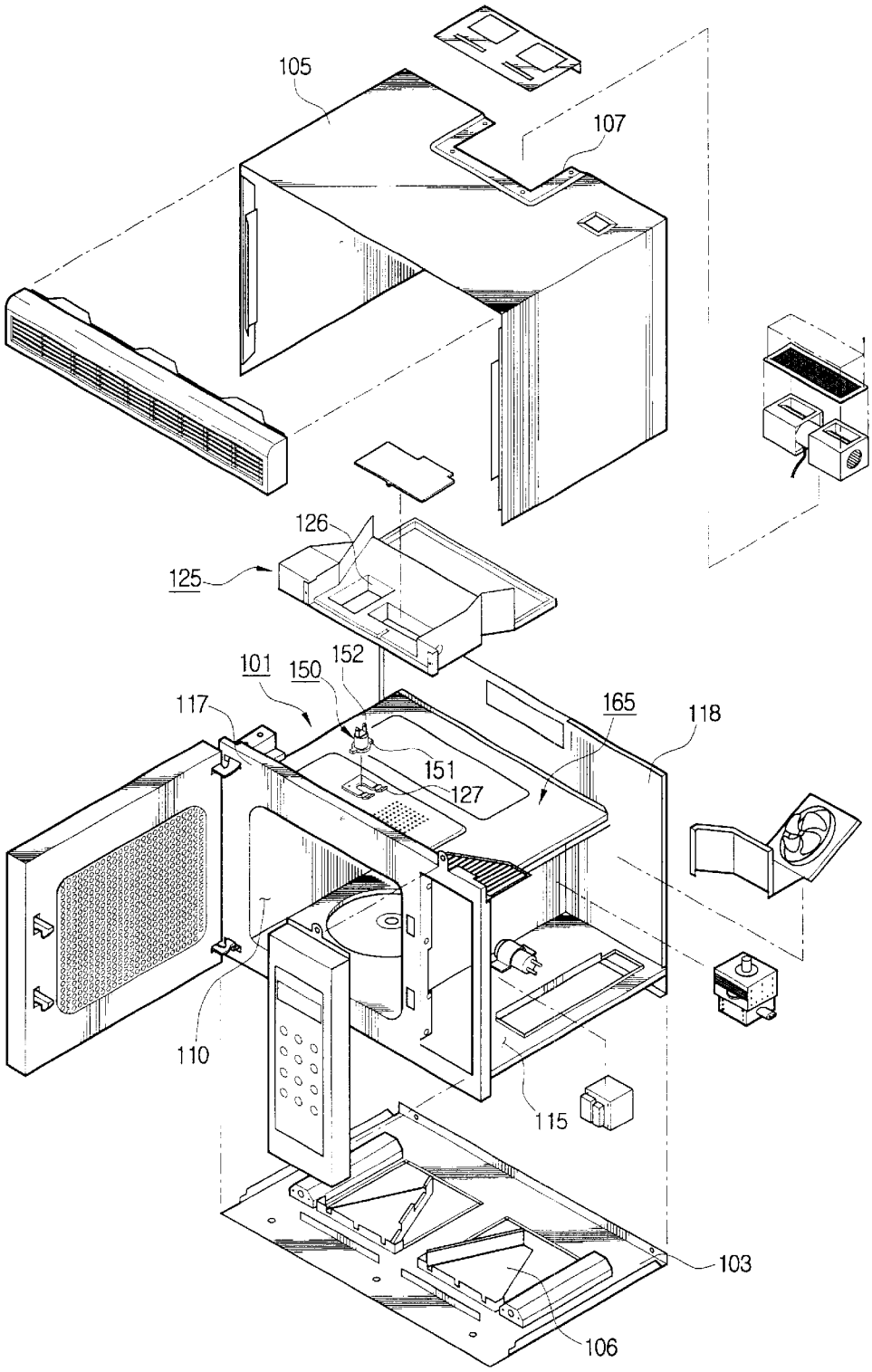
FIG. 5 (PRIOR ART)
FIG. 5 is an exploded perspective view of a conventional wall-mounted microwave oven.

Referring to FIG. 4, a spring 40 is disposed between the temperature sensor 50 and the sensor holder 30, the spring 40 being a pressing means to press the temperature sensor 50.

After the spring 40 is inserted so that it surrounds the outer surface of temperature sensor 50, temperature sensor 50 is inserted horizontally relative to sensor holder 30, and then detent 37 presses spring 40 downwardly. If detent 37 presses spring 40 downwardly, temperature sensor 50 is correctly contacted with the top face of the cavity casing.

In the present embodiment, it has been described that the spring 40 as a pressing means is disposed between the temperature sensor 50 and the sensor holder 30. However, the pressing means may be comprised of any means capable of elastically pressing the temperature sensor 50 downwardly.

Sensor holder 30 of the present invention may be produced in a single body by an injection molding with duct member 25. Alternatively, sensor holder 30 may be provided separately from duct member 25, and sensor holder 30 and duct member 25 can be assembled by means of a screw or any screwed coupling, to allow sensor holder 30 to be installed in recess 26. Shape of sensor holder 30 is of variety, depending upon the shape of temperature sensor 50.

Height of sensor holder 30 is variable, differently from the installation height of detent 37.

As described above, according to the present invention, a sensor holder holding the temperature sensor in the duct member is provided, thereby simplifying an operational process of the temperature sensor and decreasing the cost of production.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven having a cavity casing forming a cooking compartment, comprising:

a temperature sensor sensing a temperature of the cooking compartment;

a duct member installed on the top face of the cavity casing, guiding a flow of air, having a recess toward the cavity casing at one side thereof; and a sensor holder positioned on an inner wall of the recess in the duct member, holding the temperature sensor.

2. The microwave oven according to claim 1, said sensor holder comprising a pair of arms surrounding the outside of the temperature sensor, and a detent disposed between the pair of the arms preventing the temperature sensor from being removed therefrom.

3. The microwave oven according to claim 2, further comprising means for pressing the temperature sensor, said pressing means disposed between the temperature sensor and the sensor holder.

4. The microwave oven according to claim 3, said temperature sensor comprising a flange radially extended from one end thereof.

5. The microwave oven according to claim 4, said pressing means comprising a spring disposed between said arms and said detent, elastically pressing the temperature sensor downwardly.

6. A microwave oven according to claim 2, said pair of arms comprising: an intermediate section surrounding the outer surface of the temperature sensor; and an end section being inclined oppositely to the temperature sensor.

7. A microwave oven according to claim 6, wherein the pair of arms take the shape of an arc and are opposed to each other.

8. A microwave oven according to claim 2, said detent having a protrusion on the end of the detent.

9. A microwave oven according to claim 8, wherein the detent takes the shape of a rod and is disposed between the pair of the detent.

10. The microwave oven according to claim 1, further comprising means for pressing the temperature sensor, said pressing means disposed between the temperature sensor and the sensor holder.

11. The microwave oven according to claim 10, said temperature sensor comprising a flange radially extended from one end thereof.

* * * * *